US006294082B1

(12) United States Patent
Aldous et al.

(10) Patent No.: US 6,294,082 B1
(45) Date of Patent: Sep. 25, 2001

(54) PROCESS FOR SOLVENT EXTRACTION OF HYDROCARBONS PROVIDING AN INCREASED YIELD OF RAFFINATE

(75) Inventors: Keith K. Aldous, League City, TX (US); Joseph P. Boyle, Baton Rouge, LA (US); Michael B. Davis, Chipstead (GB)

(73) Assignee: Exxon Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/459,029

(22) Filed: Dec. 10, 1999

(51) Int. Cl.[7] ..... C10G 17/01

(52) U.S. Cl. ..... 208/311; 200/322; 200/324; 200/326

(58) Field of Search ..... 208/324, 326

(56) References Cited

U.S. PATENT DOCUMENTS

| | | | | |
|---|---|---|---|---|
| 2,933,448 | | 4/1960 | Morin et al. | 208/324 |
| 3,843,515 | * | 10/1974 | MacDonald et al. | 208/326 |
| 4,311,583 | | 1/1982 | Woodle | 208/312 |
| 4,511,537 | | 4/1985 | Fiocco et al. | 422/256 |
| 4,588,563 | | 5/1986 | Fiocco | 422/256 |
| 4,909,927 | * | 3/1990 | Bell | 208/326 |
| 5,039,399 | | 8/1991 | Sequeira, Jr. | 208/311 |
| 5,242,579 | | 9/1993 | Mead et al. | 208/312 |
| 5,616,238 | | 4/1997 | Boyle et al. | 208/314 |

* cited by examiner

*Primary Examiner*—Helane E. Myers
(74) *Attorney, Agent, or Firm*—James H. Takemoto

(57) ABSTRACT

A process for upgrading a hydrocarbon oil is provided which comprises introducing the oil and an aromatic extraction solvent containing 0.1 to 10 vol % water into an extraction zone for contact of the oil and solvent therein whereby an extract solution is formed; and injecting water into the extraction zone at a point below that at which the extraction solvent is introduced. The injected water is injected substantially countercurrent to the extraction solvent at a velocity of about 0.5 to 3 ft/sec in an amount ranging from about 0.1 to about 10 LV% based on the amount of extract solution being processed.

7 Claims, 8 Drawing Sheets

PROCESS FOR SOLVENT EXTRACTION OF HYDROCARBONS PROVIDING AN INCREASED YIELD OF RAFFINATE

FIELD OF INVENTION

This invention relates to an improved process for the solvent extraction of an aromatics containing petroleum oil fraction. More specifically the invention relates to the solvent refining of a lube oil stock in a countercurrent extraction operation in which an aromatics extraction solvent and water are employed to remove at least a portion of the aromatic type constituents from the lube oil stock.

BACKGROUND OF INVENTION

The separation of aromatics from hydrocarbon feed streams comprising mixtures of aromatics and non-aromatics by solvent extraction is a process which has long been practiced in the refining industry especially in the production of lubricating oil. The process involves the use of solvents such as phenol, furfural, n-methyl pyrrolidone which are selective for the aromatic components present in the hydrocarbon feed streams. These solvents typically are combined with water to provide a solvent mixture containing up to about 10 vol. % water. The hydrocarbon stream and the selective solvent or solvent mixture are combined, typically and preferably under counter-current conditions. The contacting results in concentration of the aromatic component in the selective solvent. Because the solvent and the hydrocarbon oil are of different densities and generally immiscible, after the contacting the aromatics rich solvent phase separates from the mixture thereby resulting in an aromatics rich solvent phase called the extract and an aromatics lean non-aromatics rich product phase called the raffinate. Because no solvent extraction process can be one hundred percent selective, the aromatics rich extract phase contains a minor but economically significant quantity of non-aromatic hydrocarbon which constitute good lube oil molecules.

Various processes have been proposed for recovering these good lube oil molecules present in the extract phase. Some of these do not provide for maximum recovery of the desired molecules. Others require increased capital costs or result in increased operating expenses. Thus, there remains a need for improvements in recovering lube oil molecules from a solvent extract which will provide greater yields at lower investment and operating costs.

SUMMARY OF INVENTION

Accordingly, a process for upgrading a hydrocarbon oil is provided which comprises introducing the oil and an aromatic extraction solvent containing 0.1 to 10 vol % water into an extraction zone for contact of the oil and solvent therein whereby an extract solution is formed; and injecting water into the extraction zone at a point below that at which the extraction solvent is introduced. The injected water is injected substantially countercurrent to the extraction solvent at a velocity of about 0.5 to 3 ft/sec in an amount ranging from about 0.1 to about 10 LV % based on the amount of extract solution being processed.

DETAILED DESCRIPTION OF THE INVENTION

Extraction towers useful in the present process include those set forth in U.S. Pat. Nos. 4,511,537 and 4,588,563 which patents are incorporated herein by reference. For convenience, however, the process will be described only in conjunction with a cascade linear type extraction tower such as that of U.S. Pat. No. 4,511,537.

Figure 1:
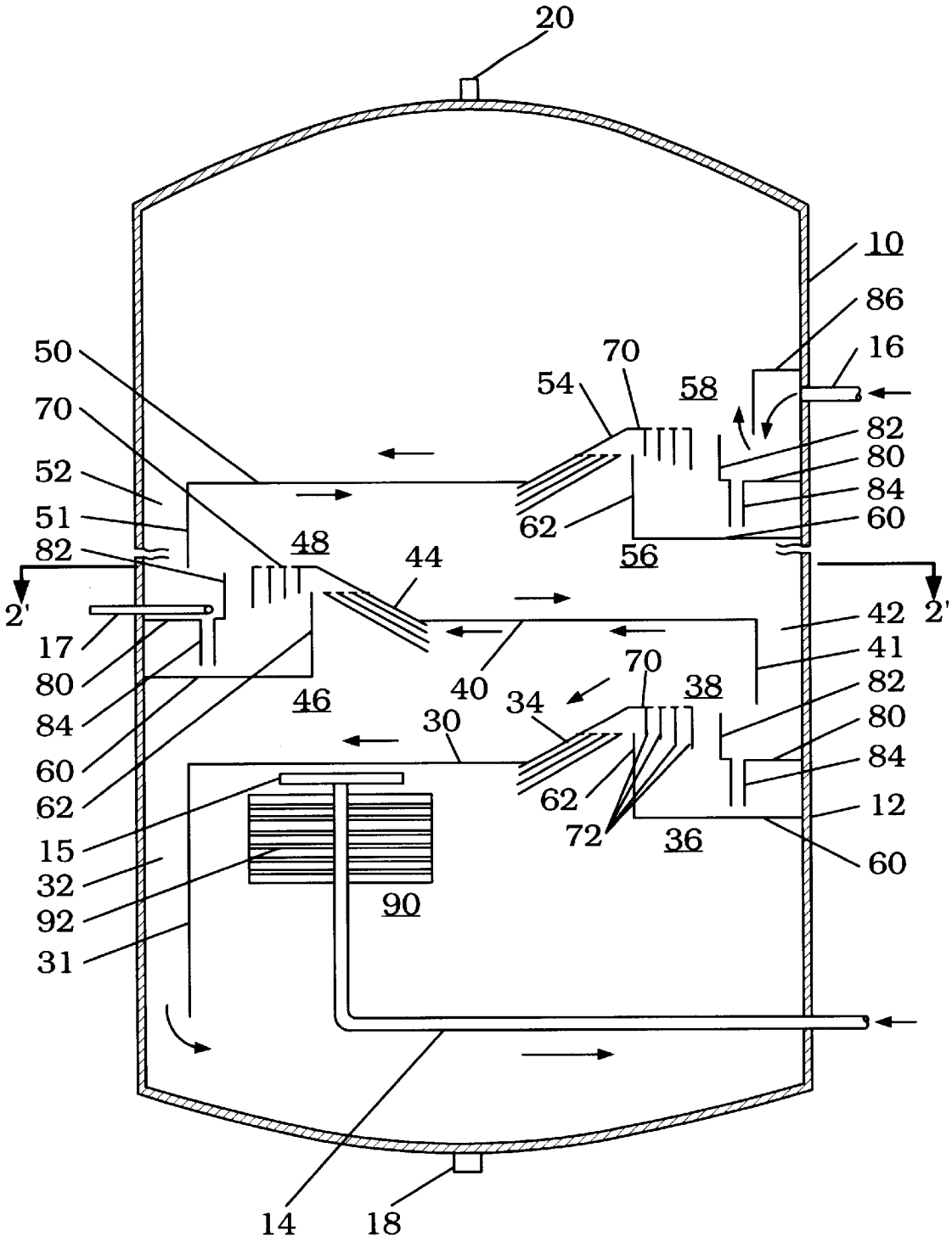
FIG. 1 is a simplified sectional view of an extraction zone useful in the present invention.

Referring first to FIG. 1, an extraction zone 10 is shown comprising a tower 12, having a feed inlet 14 for introducing a lube oil feedstock such as a distillate feed, an aromatic extraction solvent inlet 16, an extract outlet 18 and raffinate outlet 20. Feed inlet 14 is shown extending into tower 10 and terminating at diffuser means 15. Tower 12 is shown having three vertically spaced apart tray means, such as trays 30, 40 and 50, which preferably are substantially horizontally disposed. Affixed to the outer periphery of trays 30, 40, 50, are vertical extending sections, 31, 41, 51, respectively, which cooperate with the inner surface of tower 12 to define downcomer means 32, 42, 52 for directing the flow of solvent from each tray to a location beneath that tray. Also associated with each tray 30, 40 and 50 are riser means 34, 44 and 54, respectively, which operate to direct the light phase from each tray to an elevation higher than that respective tray.

As shown in FIG. 1, riser means 34, 44, 54 each preferably comprises a series of substantially parallel inclined fluid conduits having inlets at varying distances below the associated tray to thereby maintain a liquid level beneath the associated tray which facilitates coalescence of the light phase. Also associated with each tray 30, 40, 50 are seal means 36, 46, 56, respectively. In the instant design, seal means 36, 46, 56 each comprises a substantially horizontally extending seal pan 60 communicating with a substantially perpendicular segment 62 to define a volume above and in which is disposed cascade weir means 38, 48, 58, associated with trays 30, 40, 50, respectively. Each cascade weir means, such as cascade weir means 38, has a series of substantially horizontally disposed vertically depending sections, such as sections 72, depending from perforate means, such as perforate plate 70 having a plurality of orifices. The vertically depending sections are disposed spaced apart in the flow path of the light phase, the depth of the sections preferably increasing slightly with increasing distance from perpendicular segment 62. Seal means 36, 46 and 56 are shown having a baffle means 80, generally vertical sections 82 and drain pipe means 84. Baffle means 86, disposed in close proximity to inlet 16 directs the entering solvent downwardly. Coalescing means 90, having a plurality of coalescing screens 92, facilitates the final separation of the light phase from the heavy phase.

Importantly, tower 10 is provided with a water feed inlet 17 which is positioned in the extraction zone at a point below that at which the aromatic extraction solvent is introduced into the zone. With the tower 10 of FIG. 1 the water feed inlet 17 preferably is located in the downcomer 52 below the lower extremity of vertical plate 51 and extends inwardly substantially to the mid point between vertical section 82 and plate 51.

Figure 2:
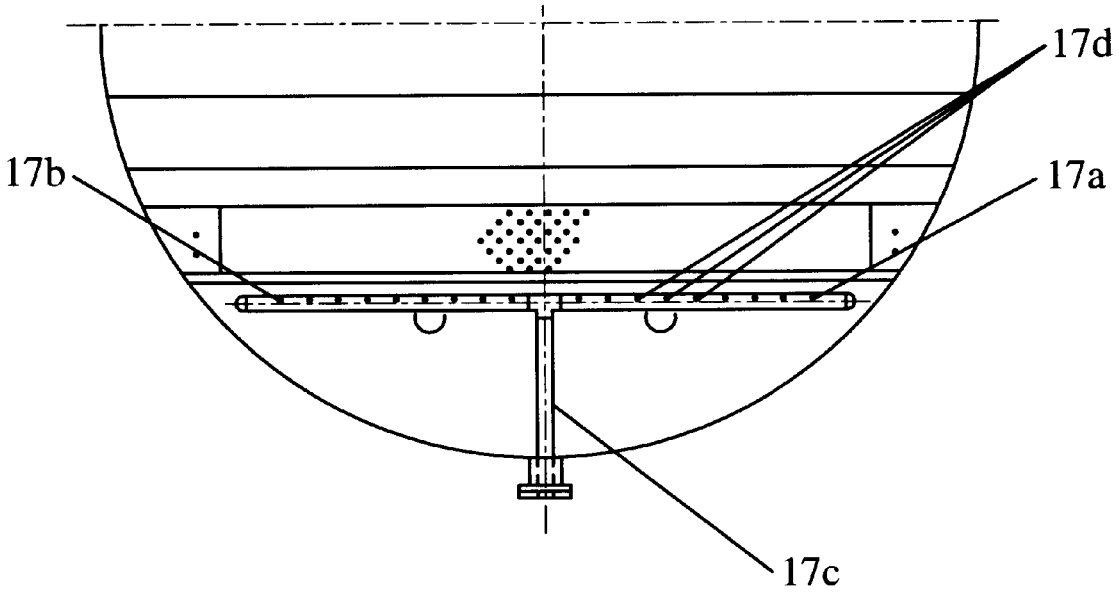
FIG. 2 is a plan view of water inlet means taken along Section 2–2' of FIG. 1.

As can be seen in FIG. 2 a preferred water feed inlet 17 has a straight run portion 17*c* with arms 17*a* and 17*b* disposed substantially at right angles to portion 17*c*. Arms 17*b* and 17*a* extend substantially to the wall 12 of the tower 10. The arm's 17*b* and 17*a* are provided with a plurality of orifices 17*d*, generally equally spaced apart, and positioned to permit the injection of water upwardly, i.e., substantially countercurrently, into the solvent phase.

Figure 3:
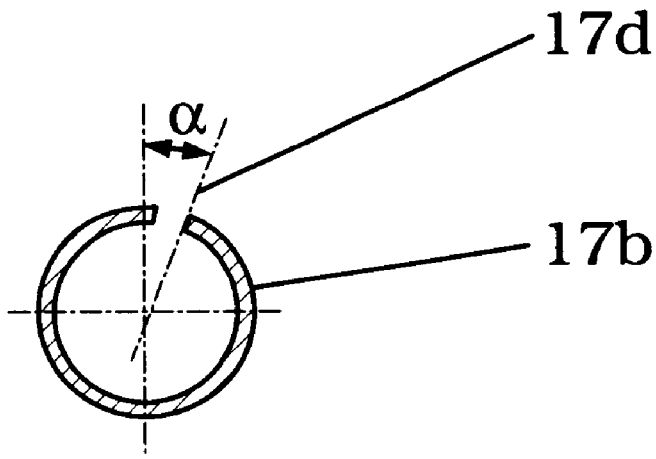
FIG. 3 is a detailed view of the water inlet means of FIGS. 1 and 2.

In a particularly preferred arrangement the orifices are directed toward the vertical downcomer plate 51 at an angle, ∝, from the vertical, as shown in FIG. 3. In general ∝ is from 5° to 45° from the vertical and preferably is 15° and directed towards the downcomer plate 51.

In operation a lube oil feed; such as a paraffinic or naphthenic feed, or blends of these, enters tower 12 through line 14 and diffuser 15 to form a light phase layer, indicated by the small dots below tray 30. The light phase flows in the direction of the shorter arrows through the tower. A denser aromatic extraction solvent, such as furfural, phenol or n-methyl-pyrollidone (NMP) and especially NMP, which has been premixed with water to contain from about 0.1 to about 10 vol % water, and preferably from 0.5 to 5 vol % water enters inlet 16 and passes downwardly as shown by the longer arrows forming an extract solution. As the dense, extract solution phase passes through downcomer 52 it is contacted counter currently with water injected via inlet 17 substantially upwardly into the downwardly flowing dense, extract solution phase in the downcomer. Importantly the water is injected at a velocity of about 0.5 to about 3 ft/sec. and in the range of about 0.1 to about 10 LV % and preferably from 1.0 to 5 LV % based on the volume of extract solvent being processed. Preferably the water is injected at an angle of about 5° to 30° from the vertical and especially at 15° from the vertical in the direction of the downcomer plate 51. The light phase ultimately is removed via line 20 while the extract phase is removed via line 18.

Any conventional process may be employed to separate solvent from the light and dense phases and the recovered solvent may be recycled to the extraction zone.

Figure 4:
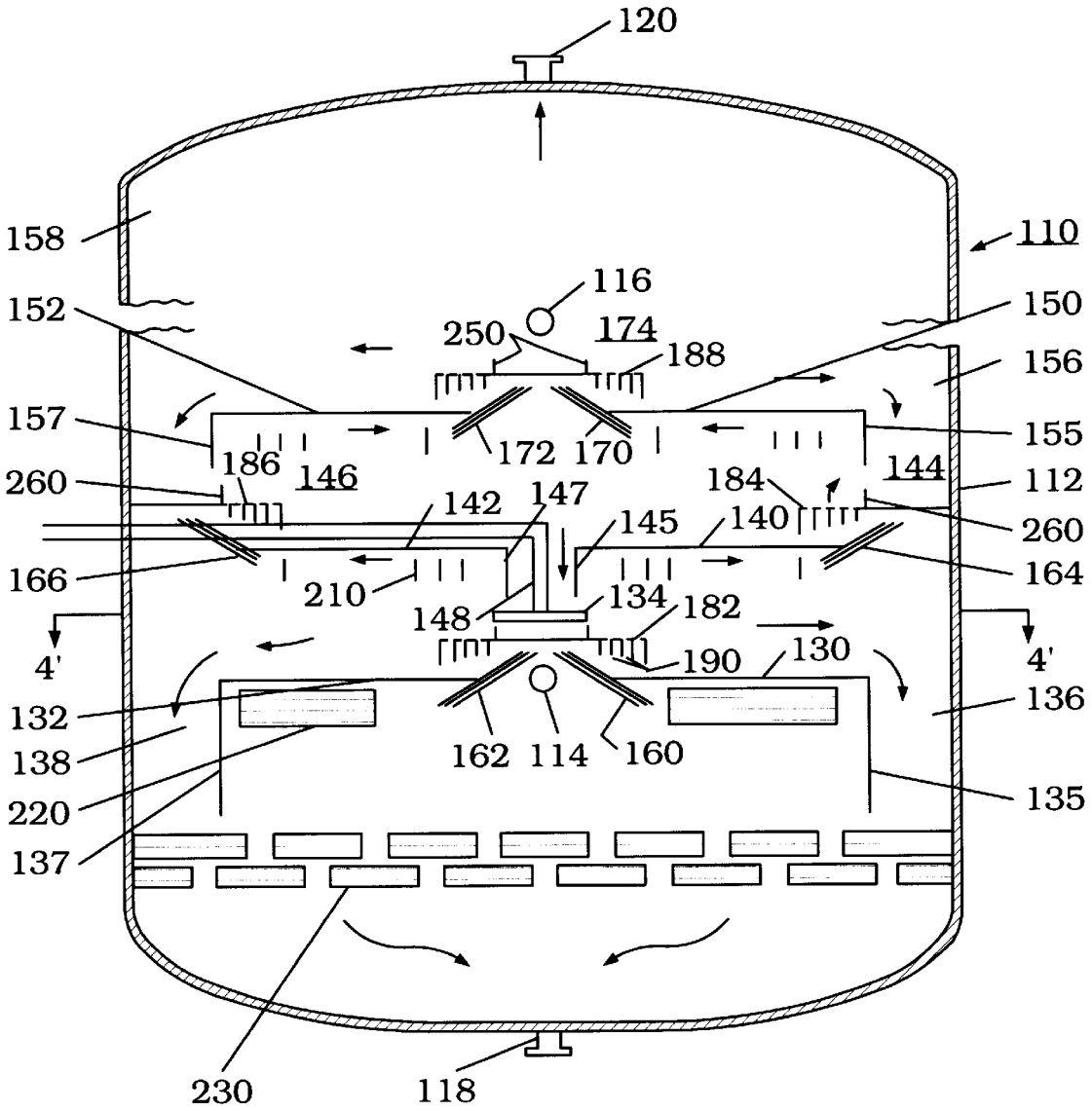
FIG. 4 is a simplified sectional view of a double pass extraction zone useful in the present invention.

Referring to FIG. 4 a dual pass countercurrent flow extraction zone 110 is shown. In this embodiment the light phase is indicated by the small dots and the flow path of the light phase is indicated by the relatively short arrows, while the flow path of the heavy phase is indicated by the longer arrows. In this embodiment, tower 112 is shown having a feed inlet 114, solvent inlet 116, extract outlet 118 and raffinate outlet 120. Tower 112 has a series of horizontally disposed, spaced apart trays. Each tray comprises a pair of tray halves, such as tray halves or segments 130 and 132; 140 and 142; 150 and 152. Inclined riser means such as 160, 162, associated with tray segments 130, 132, respectively direct the light phase from beneath each respective tray segment to a common cascade weir means, such as weir means 134. Riser means, 160, 162, preferably comprise a series of parallel conduits having fluid inlets at varying distances below the associated tray. Common cascade weir means 134 preferably comprises a substantially horizontally disposed perforate plate 182. Beneath each weir means, such as weir means 134, are a series of vertical segments or sections 190 which preferably increase in depth with increasing distance from the center of tower 112. Tray segments 140 and 142, disposed above cascade weir 134, redirect the upwardly flowing fluid stream outwardly. Riser means 164, 166, associated with tray segments 140, 142, respectively, direct the light phase from beneath the tray segments to outwardly disposed cascade weir means 144, 146, respectively. Weir means 144, 146 comprise perforate plates 184, 186, respectively, and a series of vertical extending sections 190, with the depth of the vertical sections preferably increasing gradually with increasing proximity to the center of tower 112. Fluid passing upwardly through perforate plates 184, 186, is redirected by tray segments 150, 152, respectively. The light phase from trays 150, 152 passes through riser means 170, 172, respectively, to common cascade weir means 174.

Simultaneously, the more dense extract solution liquid enters tower 112 through solvent inlet 116 and passes over common weir means 174 and thence onto tray segments 150, 152. In the embodiment shown in FIG. 4 vertically extending sections 135, 137, 155, 157 of tray segments 130, 132, 150, 152, respectively, each cooperate with the inner surface of tower 112 to define downcomer means 136, 138, 156, 158, respectively. Similarly, vertically extending sections 145, 147, associated with tray segments 140, 142, respectively, cooperate to define downcomer means 148. Deflector baffle means 250 preferably are disposed on the upper surface of common cascade weir means 134, 174 to minimize direct impingement of the downflowing heavy extract solution phase on lube oil droplets being formed. Similarly deflector baffle means 260 are disposed on the upper surface of cascade weir means 144, 146. Coalescing means, such as coalescing screens 230 may be installed near the base of tower 112 to facilitate coalescence and separation of light phase droplets as hereinbefore indicated before the heavier extract solution phase exits from the tower.

An important feature of the present invention is the provision in tower 110 of a water feed inlet 117 which is positioned in the extraction zone at a point below that at which the solvent that has been premixed with water is introduced into the zone. As shown in FIG. 4 the water feed inlet 117 preferably extends into the downcomer 148.

Figure 5:
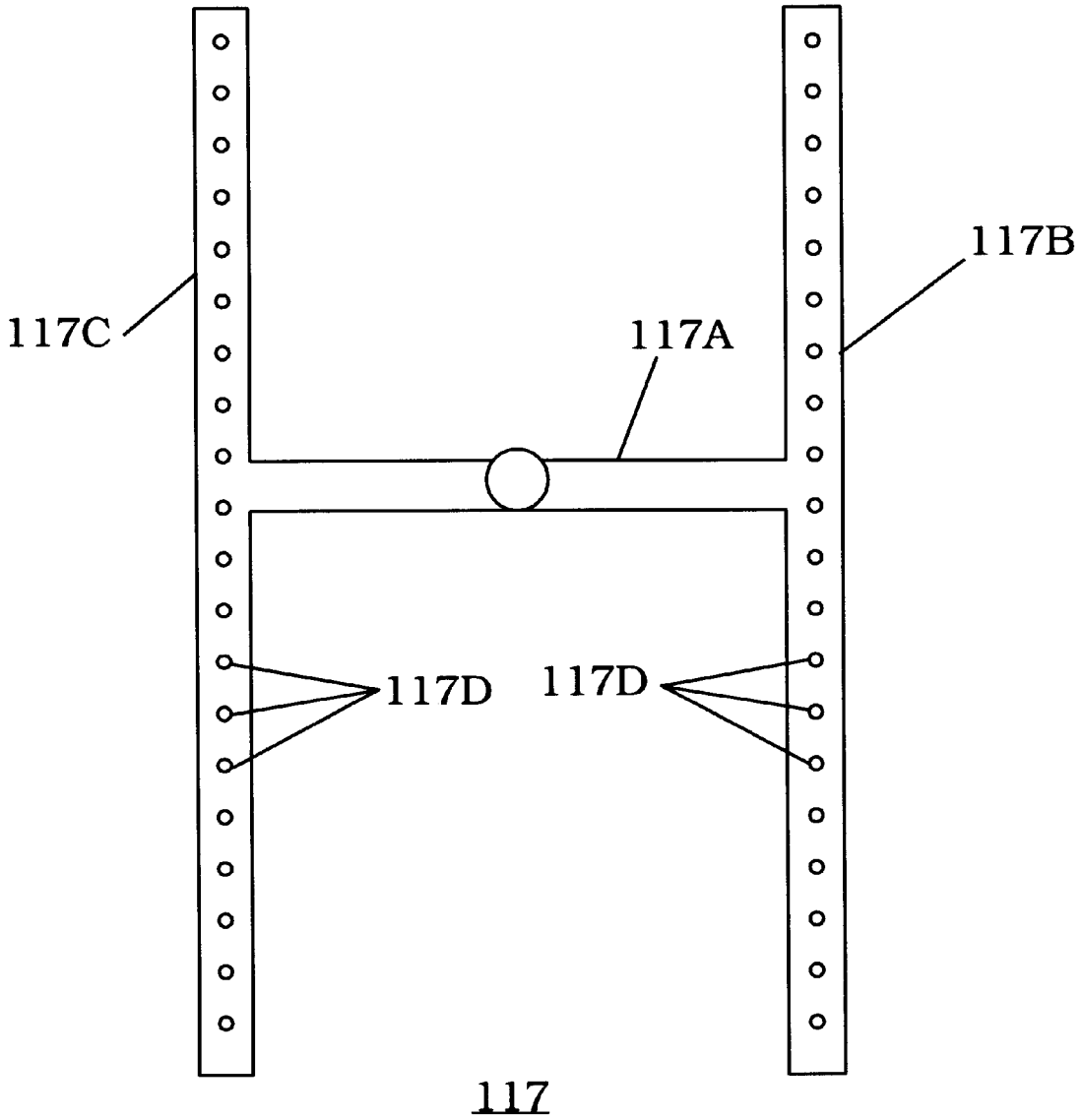
FIG. 5 is a plan view taken along section 4–4' of FIG. 4.

As can be seen in FIG. 5 the feed inlet 117 has a horizontally disposed manifold 117*a* which delivers feed to arms 117*b* and 117*c*. Arms 117*b* and 117*c* are positioned below the lower extremity of plates 147 and 145 at substantially the midpoint between weir 250 and plates 147 and 145. A plurality of orifices 117*d* are spaced apart and upwardly directed toward plates 147 and 145 at an angle, , as described in connection with inlet 17 of FIG. 1. In operation lube oil enters tower 112 through oil inlet distributor 114 to form a light phase indicated by the small dots. This light phase flows in the direction of the shorter arrows through the tower. A more dense, water containing, aromatic extraction solvent phase, such a NMP and water mixtures, enters inlet 116 and passes downwardly as shown by the longer arrows. As the dense phase passes through downcomer 148 forming an extract solution, the extract solution is contacted counter currently with water injected via inlet 117.

While the extraction process described above is described in conjunction with a single pass or double pass tower, it is clear that the aforementioned technology is equally applicable to processes in which towers having more than two passes are employed. Also, while the single pass and double pass extraction towers shown herein are each comprised of three trays for simplicity, commercial extraction towers typically will comprise from about 5 to about 50 trays, preferably 10 to 30 trays.

EXAMPLE 1

Figure 6:
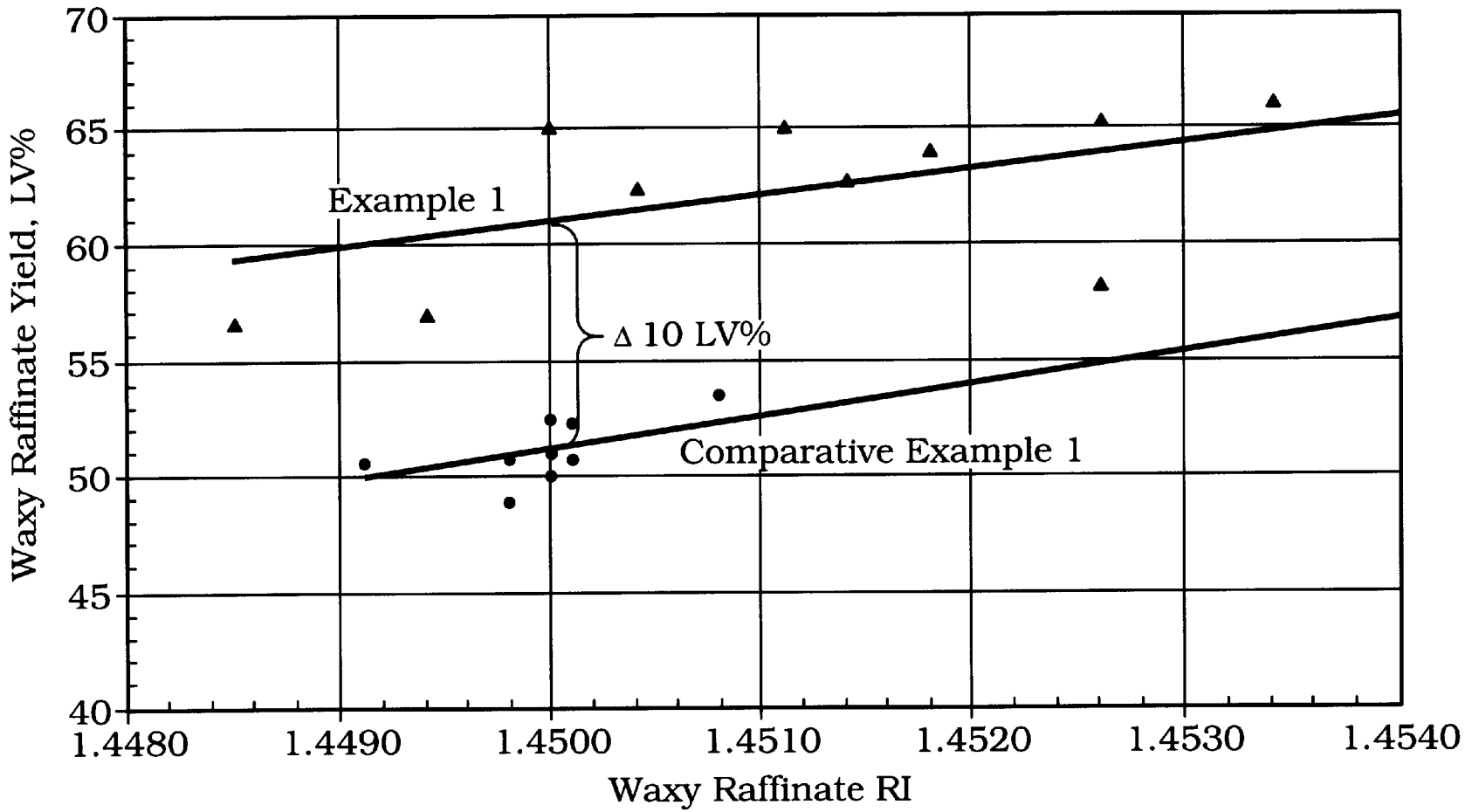
FIG. 6 illustrates the yield advantage of the invention when compared to extracting oil without additional water injection.
Figure 7:
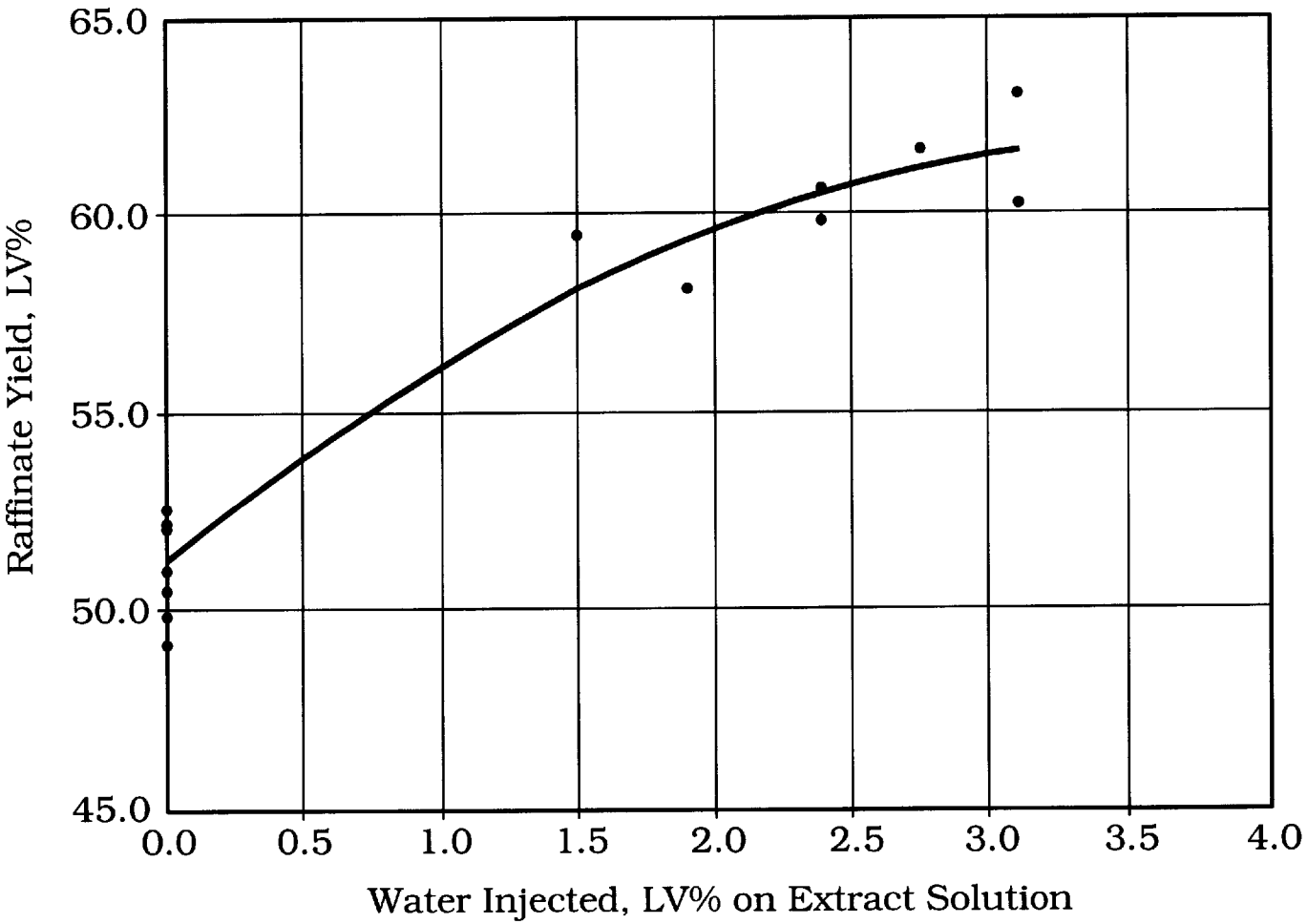
FIG. 7 illustrates the relationship between water injection and yield of raffinate using a 100 N distillate feed.

In this example a 100N distillate was fed to a single pass cascade weir trayed treater such as FIGS. 1, 2 and 3. Treating condition were: 1.6 vol % $H_2O$ in NMP solvent; bottom and top temperatures of 167° F. and 192° F.; solvent adjusted as necessary to maintain a raffinate dewaxed VI of 98 at −18° C. pour point; water injection in the range of 1.4 to 3.7 LV % on extract solution. The yield of raffinate is plotted in FIG. 6. The relationship between water injected and yield at constant quality is shown in FIG. 7.

Comparative Example 1

The procedure of Example 1 was followed except no water was injected into the treater. The yield of raffinate is also plotted in FIG. 6.

As can be seen the process of the invention shows a 10 LV % yield advantage.

EXAMPLE 2

Figure 8:
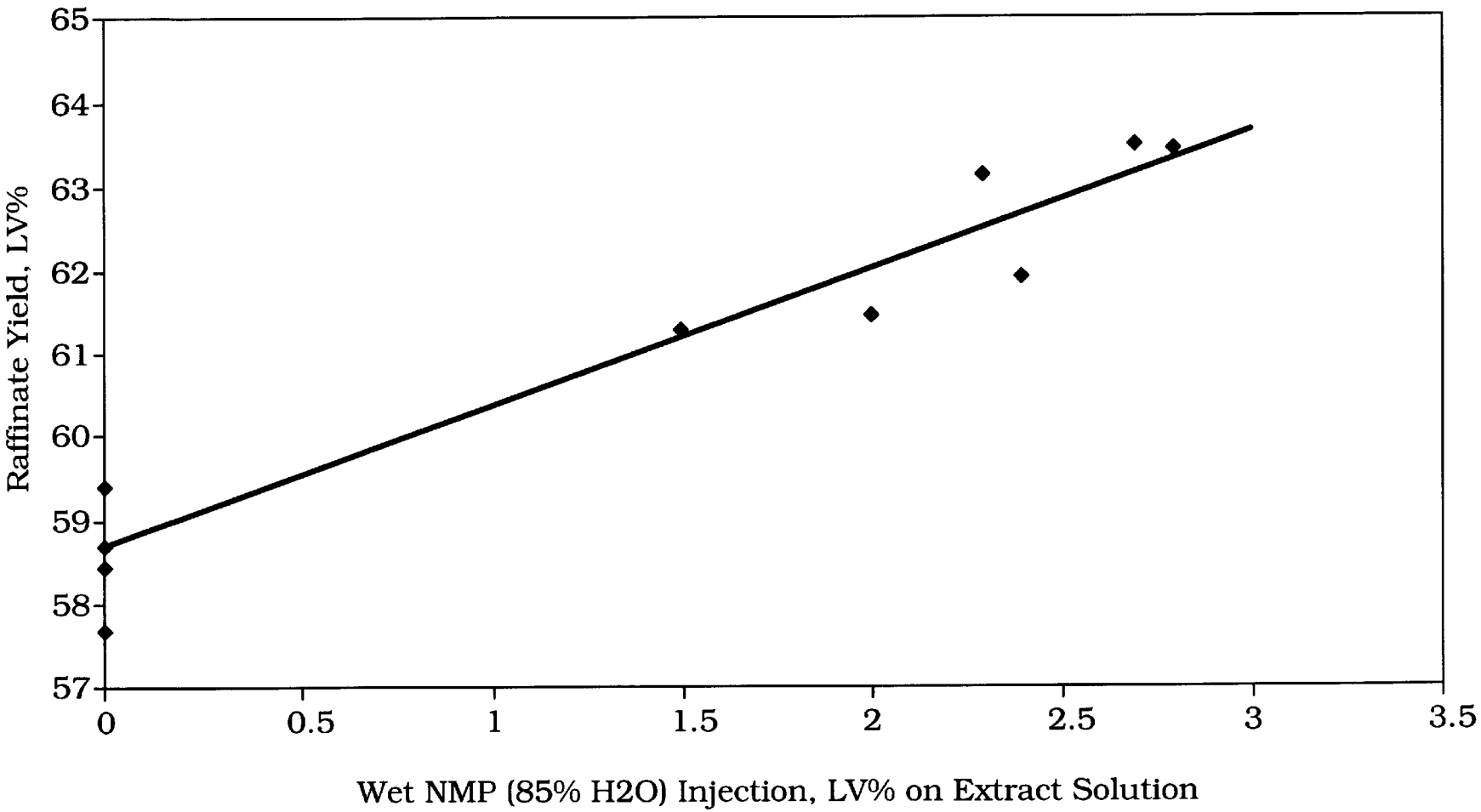
FIG. 8 illustrates the relationship between water injection and yield of raffinate using a 600 N distillate.

In this example a 600 N distillate was fed to a dual pass cascade weir trayed treater such as FIGS. 4 and 5. Treating conditions were: 2 vol % $H_2O$ in NMP solvent; bottom and top temperatures of 200° F. and 220° F.; solvent adjusted as necessary to maintain a raffinate dewaxed VI of 98 at −18° C. pour point; water injection in the range of 1.5 to 2.8 LV % on extract solution. The relationship between water injected and yield at constant quality is shown in FIG. 8.

Comparative Example 2

The procedure of Example 2 was followed except no water was injected into the treater. The yield of raffinate is also plotted in FIG. 8.

As can be seen the process of the invention shows a 5 LV % yield advantage.

What is claimed is:

1. A process for upgrading a hydrocarbon oil comprising: introducing the oil and an aromatic extraction solvent containing about 0.1 to about 10 vol % water into an extraction zone for contact of the oil and solvent therein whereby an extract solution is formed; and injecting water into the extraction zone at a point below that at which the extraction solvent is introduced, the water being injected substantially countercurrent to the extraction solvent at a velocity of about 0.5 to about 3 ft/sec in an amount ranging from about 0.1 to about 10 LV% based on the amount of extract solution being processed.

2. The process of claim 1 wherein the water is injected in an amount ranging from about 1.0 to about 5 LV%.

3. The process of claim 2 wherein the water is injected at an angle of about 5° to about 30° from the vertical.

4. The process of claim 3 wherein the extraction solvent is NMP.

5. A countercurrent extraction process for upgrading a hydrocarbon oil comprising:

introducing a hydrocarbon oil in an extraction tower for upward passage therethrough, the extraction tower having a plurality of trays and downcomers;

introducing an aromatic extraction solvent in the extraction tower for downward passage therethrough whereby the oil and solvent are counter currently contacted thereby forming an extract solution, the solvent containing about 0.1 to about 10 LV% water;

injecting water upwardly into the extraction tower in the direction of a downcomer at point below that at which the extraction solvent is introduced, the injection being at a velocity in the range of about 0.5 to about 3 ft/sec in an amount ranging from about 0.1 to about 10 LV% based on the amount of extract solvent being processed.

6. The process of claim 5 wherein the water is injected upwardly at an angle of from about 5° to about 30° from the vertical.

7. The process of claim 6 wherein the extraction solvent is NMP.

* * * * *